US005758936A

United States Patent [19]

Baughan

[11] Patent Number: 5,758,936

[45] Date of Patent: Jun. 2, 1998

[54] JEWELRY SECURITY CABINET

[76] Inventor: Lana J. Baughan, 1206 Newry La., Duncansville, Pa. 16635

[21] Appl. No.: 628,782

[22] Filed: Apr. 5, 1996

[51] Int. Cl.[6] ..... A47B 67/00

[52] U.S. Cl. ..... 312/245; 312/310; 312/227; 312/293.2; 206/6.1

[58] Field of Search ..... 312/245, 242, 312/310, 311, 227, 329, 293.2, 293.1; 206/6.1, 566; 220/528, 481; 232/33, 29, 27

[56] References Cited

U.S. PATENT DOCUMENTS

| | | | |
|---|---|---|---|
| 2,199,731 | 5/1940 | Pryne | 312/310 |
| 2,940,200 | 6/1960 | Endlich | 312/293.2 |
| 3,639,022 | 2/1972 | Elmo | 312/245 |
| 3,930,702 | 1/1976 | Pichowicz | 312/245 |
| 3,997,219 | 12/1976 | Phelps | 312/245 X |
| 4,209,212 | 6/1980 | McGoldrick | 312/245 |
| 4,304,447 | 12/1981 | Ellwood et al. | 312/245 X |
| 4,324,446 | 4/1982 | LeSage | 312/245 |
| 4,413,736 | 11/1983 | Nibling | 312/245 X |
| 4,776,650 | 10/1988 | Ferenzi | 312/245 |
| 4,978,001 | 12/1990 | Nelson | 206/6.1 X |
| 5,035,319 | 7/1991 | Kunisch | 206/6.1 |
| 5,244,268 | 9/1993 | Derrickson | 312/293.2 X |
| 5,246,103 | 9/1993 | Hicks | 206/6.1 |
| 5,511,873 | 4/1996 | Mech | 312/293.2 X |
| 5,577,819 | 11/1996 | Olsen | 312/242 |

FOREIGN PATENT DOCUMENTS

| | | | |
|---|---|---|---|
| 1054666 | 5/1979 | Canada | 312/242 |

*Primary Examiner*—Peter M. Cuomo
*Assistant Examiner*—Janet M. Wilkens
*Attorney, Agent, or Firm*—Kenneth P. Glynn, Esq

[57] ABSTRACT

A jewelry security cabinet for the storage and display of objects, specifically necklaces, pendants, rings and earrings. It includes a front cover structure and a rear box-type structure. The mounting surface of the rear box-type structure is constructed to hang on a wall or be set recessed into a wall. The outside surface of the front cover structure is constructed to appear like a picture or a mirror. The front cover structure may be larger than the rear box-type structure to enhance the invisibility aspect. The front cover structure and the rear box-type structure are hingedly connected and have a closure for securing the jewelry security cabinet. The inner surfaces have pins and hangers so as to hold selected objects. Within the rear box-type structure are two detachable display cases. One of the cases is hingedly attached, such that it is swingable and easily removable and holds, for example, earrings. The other case may be a slotted ring holder.

11 Claims, 4 Drawing Sheets

JEWELRY SECURITY CABINET

BACKGROUND OF THE INVENTION

1. Field of the Invention

The present invention relates in general to cabinets or other such containment devices which are used to store jewelry and other such items. Specifically, the present invention is directed to the type of devices which can be mounted onto or inside a wall, and having a front portion whose appearance conceals the true nature of the device. More specifically, the present invention pertains to dual purpose containers for the storing and transportation of jewelry.

2. Information Disclosure Statement

The following patents are examples containers which have attempted to provide a suitable storage capabilities for jewelry and other such items.

U.S. Pat. No. 4,304,447 issued to Ellwood et al. describes a jewelry cabinet which can be attached to the wall. Two box-like components (a cover box and a wall box) are connected via a hinge, such that in an open position, the insides of both box-like components are exposed. The cover box is larger than the wall box so as to conceal the wall box when it is in a closed position. The cover box preferably has an ornamental device on the front, making it look like a picture frame or mirror.

U.S. Pat. No. 3,997,219 issued to Phelps describes a jewelry cabinet for placement upon a table. The cabinet has a transparent cover, which is adapted with shelves for the placement of jewelry. The cover swings in and out of the cabinet structure.

U.S. Pat. No. 4,209,212 issued to McGoldrick describes a jewelry housing which has two sections which employ a sheet having a wadding-like material covered by a fabric-like material. The sheet has a plurality of nails disposed angularly upward from the sheet to hold jewelry. A flap-like fabric sheet member is also provided to hold pierced earrings and other such items. A light is also provided such that the user can use it at night. The cabinet may be either placed upon a table or a wall.

U.S. Pat. No. 4,324,446 issued to LeSage describes a jewelry cabinet having a front and a back portion. The front portion and back portion are connected via a hinge and are both adapted to hold and display jewelry. A transparent cover is attached in a hinge manner to both the front and back portions to keep the items in an organized and orderly fashion.

U.S. Pat. No. 4,413,736 issued to Nibling describes a jewelry container for mounting on a wall. The cover has means for attaching a frame structure which personalizes the appearance of the container. The container also has means for preventing access to the interior of the container.

U.S. Pat. No. 4,776,650 issued to Ferenzi describes a wall mounted cosmetic center which can hold a variety of objects, including jewelry. The center includes drawers, a mirror, hanging pins and shelf units.

Notwithstanding the above prior art, it is believed that the device and method set forth herein is neither taught nor rendered obvious.

SUMMARY AND OBJECTS OF THE INVENTION

The present invention is a jewelry security cabinet which can be used for the storage of jewelry and for the transportation of jewelry when the user is on travel. In other words, it has the dual purpose of safely storing jewelry at home or for carrying jewelry when the user is on travel. The present invention has a main cabinet or structure and has at least two traveling jewelry display cases. The traveling jewelry display cases are removably mounted within the main structure or cabinet.

The jewelry security cabinet has a front cover structure and a rear box-type structure connected via a hinge mechanism. Both the front cover structure and the rear box-type structure have an inner surface which is lined with cork and contains various types of pins and hooks for holding jewelry. The outside surface of the front cover structure is made to resemble a mirror or a picture frame and can be larger than the rear box-type structure for concealment purposes. When the jewelry security cabinet is permanently mounted on the wall or recessed into the wall, the nature of the cabinet remains unseen from burglars and others.

The jewelry security cabinet is also used for the transportation of jewelry when the user is on travel. This is accomplished by providing traveling jewelry display cases which can be removed from the main cabinet when necessary. When placed in the main cabinet, they are detachably attached to the rear box-type structure. One of the traveling jewelry display cases is attached in a detachable hinge-type manner, such that it can swung out when it is in the main cabinet. The hingedly attached traveling jewelry display case is made of a clear, transparent material so that the jewelry can be easily seen. An optional traveling pouch is provided for the user's convenience. The traveling pouch can be made to hold one or both of the traveling jewelry display cases. The traveling pouch is positioned behind the hingedly attached traveling jewelry display case and is attached to the inner surface of the cabinet via looped and hooked filament attachment mechanisms.

The advantage of the present invention is that the user can detach the jewelry case from the cabinet without having to pick or choose a particular set of jewelry and/or risk losing the jewelry on travel. It provides an easy way of carrying jewelry without any risk of damaging the items and can afterward be easily attached to the permanently attached cabinet structure.

The present invention accomplishes the above functionality and corrects the defects of past devices.

BRIEF DESCRIPTION OF THE DRAWINGS

The present invention should be more fully understood when the specification herein is taken in conjunction with the drawings appended thereto, wherein.

DETAILED DESCRIPTION OF THE PRESENT INVENTION

The present invention is a jewelry cabinet which can be used for the dual purpose of safely storing jewelry at home or for carrying jewelry when the user is on travel. The present invention accomplishes the first by having a cabinet which has a front cover structure and a rear box-type structure connected via a hinge. Both the front cover structure and the rear box-type structure are lined with cork and have various types of pins and hooks for holding jewelry. The outside surface of the front cover structure is made to resemble a mirror or a picture frame and can be larger than the rear box-type structure for concealment purposes. When the cabinet is permanently mounted on the wall or recessed into the wall, the nature of the cabinet remains unseen.

The cabinet can also be used for carrying jewelry when the user is on travel. This is accomplished by jewelry cases which are detachably attached to the rear box-type structure. The advantage of the present invention is that the user can detach the jewelry case from the cabinet without having to pick or choose a particular set of jewelry and/or risk losing the jewelry on travel. It provides an easy way of carrying jewelry without any risk of damaging the items and can afterward be easily attached to the permanently attached cabinet structure. The jewelry case is made of a clear, transparent material so that the jewelry can be easily seen. An optional traveling pouch is provided for the user's convenience.

Figure 1:
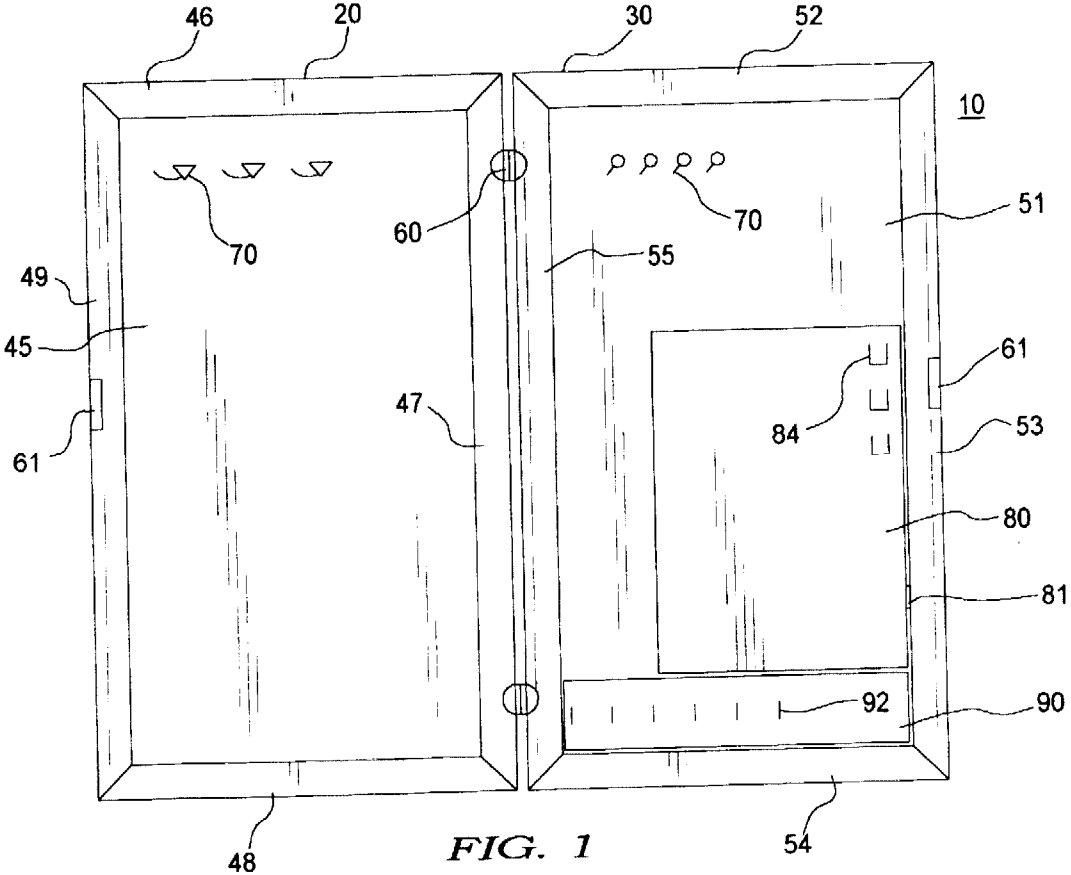
FIG. 1 shows an embodiment of the present invention in an open condition.

Referring to FIG. 1, the present invention is a jewelry security cabinet which provides a safe means for keeping jewelry at home and additionally, provides an easy means for carrying the jewelry when on travel. An embodiment of the jewelry security cabinet is generally depicted as 10.

Jewelry security cabinet 10 consists of a front cover structure 20 and a rear box-type structure 30. Front box-type structure 20 has an outside surface 40 (shown in FIG. 2), and a first inner surface 45. Rear box-type structure 30 has a mounting surface 50 (see FIG. 3), a second inner surface 51 and a set of four side walls 52, 53, 54 and 55.

Front cover structure 20 and a rear box-type structure 30 are connected via a hinge-type mechanism 60 at edge 47 and side wall 55, respectively. In an open condition, front cover structure 20 and a rear box-type structure 30 disclose the contents of jewelry security cabinet 10. In a closed condition, edge 49 and side wall 53 are provided with a magnetic closing mechanism 60 and 61, which prevents jewelry security cabinet 10 from opening indiscriminately. A locking closure could be provided instead of magnetic closing mechanism and to ensure a more secure and safe keeping place for the jewelry.

Figure 2:
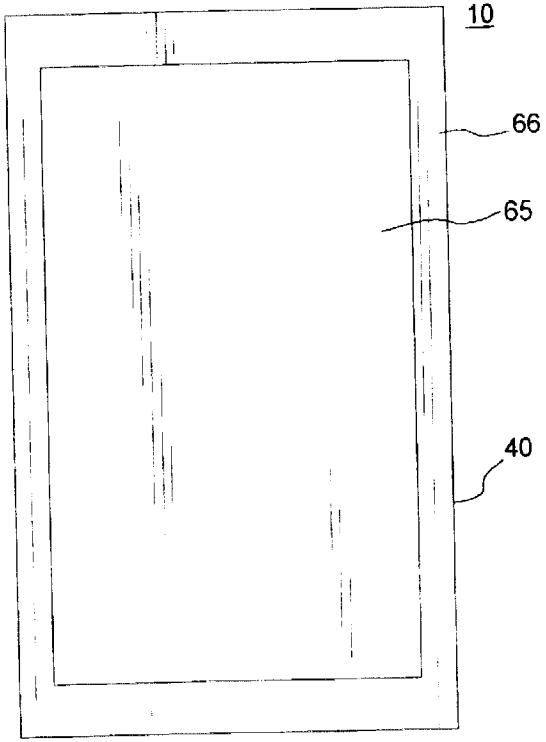
FIG. 2 shows the front cover of the embodiment shown in FIG. 1.

Referring to FIG. 2, front cover structure 20 has an outside surface 40 to provide concealment. Outside surface 40 can be any of a number of nominal wall-type decorations, including mirrors and picture frames. Outside surface 40, for example, depicts a mirror 65 with a wood finish boundary 66. Selection of outside surface 40 should be done so as to fit in with the rest of the decorations in the room. This enhances the ability of outside surface 40 to conceal the true nature of the jewelry security cabinet 10.

Figure 3:
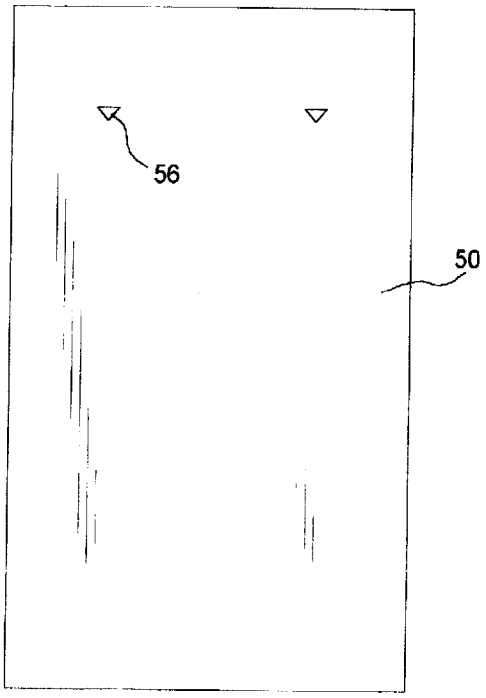
FIG. 3 shows a mounting surface of the embodiment shown in FIG. 1.

Referring now to FIG. 3, rear box-type structure 30 has mounting surface 50. Mounting surface 50 has a wall hanging device 56 for positioning jewelry security cabinet 10 on a wall. Wall hanging device 56 can be any conventional means available, i.e. wall hangers, for mounting pictures, mirrors or other such items on a wall surface. Jewelry security cabinet can also be recessed in a wall for maximum security. Either attachment approach requires no table space and decreases the chances of the jewelry or jewelry security cabinet 10 from being damaged to due it being knocked down or falling off of the table.

Referring back to FIG. 1, first inner surface 45 is lined with cork or other similar penetrable material and subsequently covered with a velvet, felt or similar type of material. A plurality of hanging devices 70 are secured to first inner surface 45 so as to hold a variety of jewelry, including bracelets, necklaces and other such items. Hanging devices 70 could be hooks, pins or other similar such structures.

Second inner surface 51 is also lined with cork or some other similar material and subsequently covered with velvet or a similar fabric-type material. Plurality of hanging devices 70 are also placed on second inner surface 51.

Rear box-type structure 30 further includes a detachable jewelry case 80 and a detachable ring display 90. Detachable jewelry case 80 is removably attached to wall 53 via a removable hinge mechanism 81. Detachable jewelry case 80 is attached to wall 53 by sliding detachable jewelry case 80 with a hinge sleeve (not shown) onto hinge mechanism 81 and placing a pin (not shown) into hinge mechanism 81 and the aformentioned hinge sleeve. Detachment of detachable jewelry case 80 is simply accomplished by removing the aforesaid pin. Note that detachable jewelry case 80 can of course swing out of rear box-type structure 30 when in an attached condition. Alternatively, detachable jewelry case 80 can have a pin-type structure integrally formed on the body of detachable jewelry case 80 (i.e. resembling a hook-type structure) which slips in and out of hinge mechanism 81.

Detachable jewelry case 80 is constructed of clear, transparent materials such as plexiglass, clear plastics or clear acrylics. This allows the user and others to view all of the jewelry easily. An earring holder 84 is attached to a rear wall (not shown) of detachable jewelry case 80 which can hold both pierced and clip-on earrings. Earring holder 84 can be any of a number of conventional devices.

Detachable ring display 90 is a slotted ring holder. It allows for easy view and display of the rings. A sheet (not shown) is covered with a foam-type material which has a number of openings 92 for rings. This foam-type material is covered with a velvet or felt type material, but still allows for the placement of rings. Detachable ring display 90 is attached to rear box-type structure 30 by using removable attachment mechanisms, including filamentary loop and hook mechanisms, commonly known as "velcro".

Figure 4:
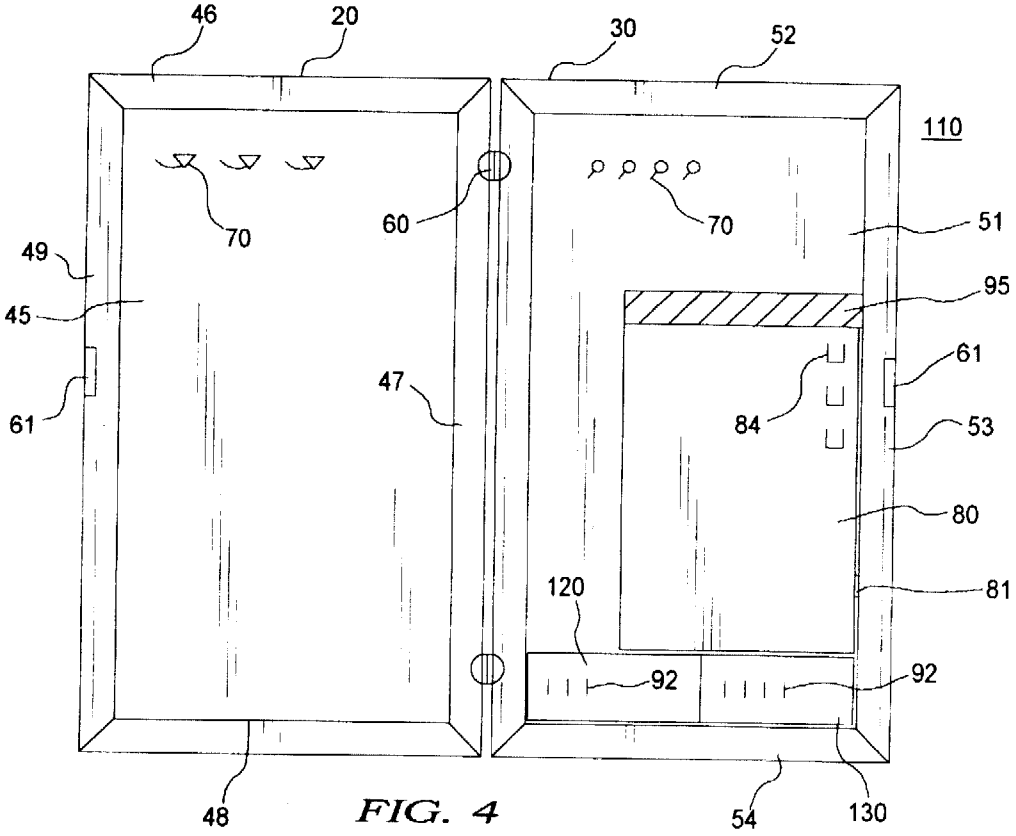
FIG. 4 shows another embodiment of the present invention in an open condition.

Referring now to FIG. 4, another embodiment of the present invention is shown and is depicted generally as 110. Items having same function and design shall be referenced by the numbers used above for FIGS. 1 and 3.

In this embodiment, jewelry security cabinet has a ring display 120 and a detachable ring display 130. Both sections are constructed as before, except that ring display 120 is permanently mounted. In this configuration, the user can select a set of specific items, place them in detachable ring display 130 and place the remaining in ring display 120.

Figure 5A:
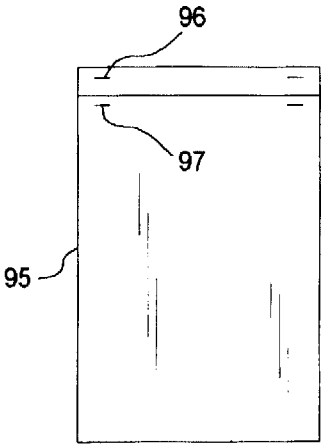
FIG. 5 (*a*) and 5(*b*) show two embodiments of the optional pouch piece.

Jewelry security cabinet 110 also includes jewelry pouch or envelope 95. Referring to FIG. 5*a*, jewelry pouch 95 is used for carrying detachable jewelry case 80 and/or a detachable ring display 130. Jewelry pouch 95 is positioned behind jewelry case 80 and attached to second inner surface 51 via removable attachment mechanisms, such as filamentary loop and hook mechanisms. Jewelry pouch 95 is made of a fabric-type material like velvet and felt. Jewelry pouch 95 can be closed to ensure that jewelry case 80 and/or detachable ring display 130 remain within jewelry pouch 95. Closure of jewelry pouch 95 is accomplished by using removable complementary attachment mechanisms 96 and 97. These can be any conventional means and include for example filamentary loop and hook mechanisms.

Figure 5B:
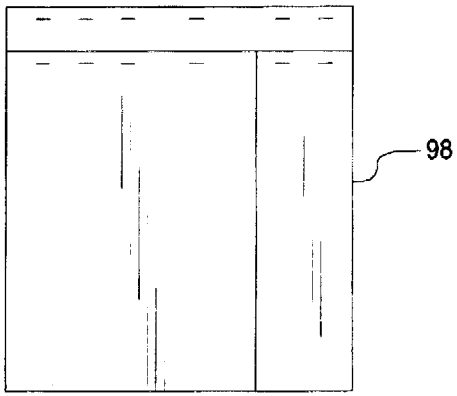

Referring now to FIG. 5*b*, another embodiment of the jewelry pouch is depicted as 98. Jewelry pouch 98 has a divided configuration for holding jewelry case 80 and detachable ring display 130.

Figure 6:
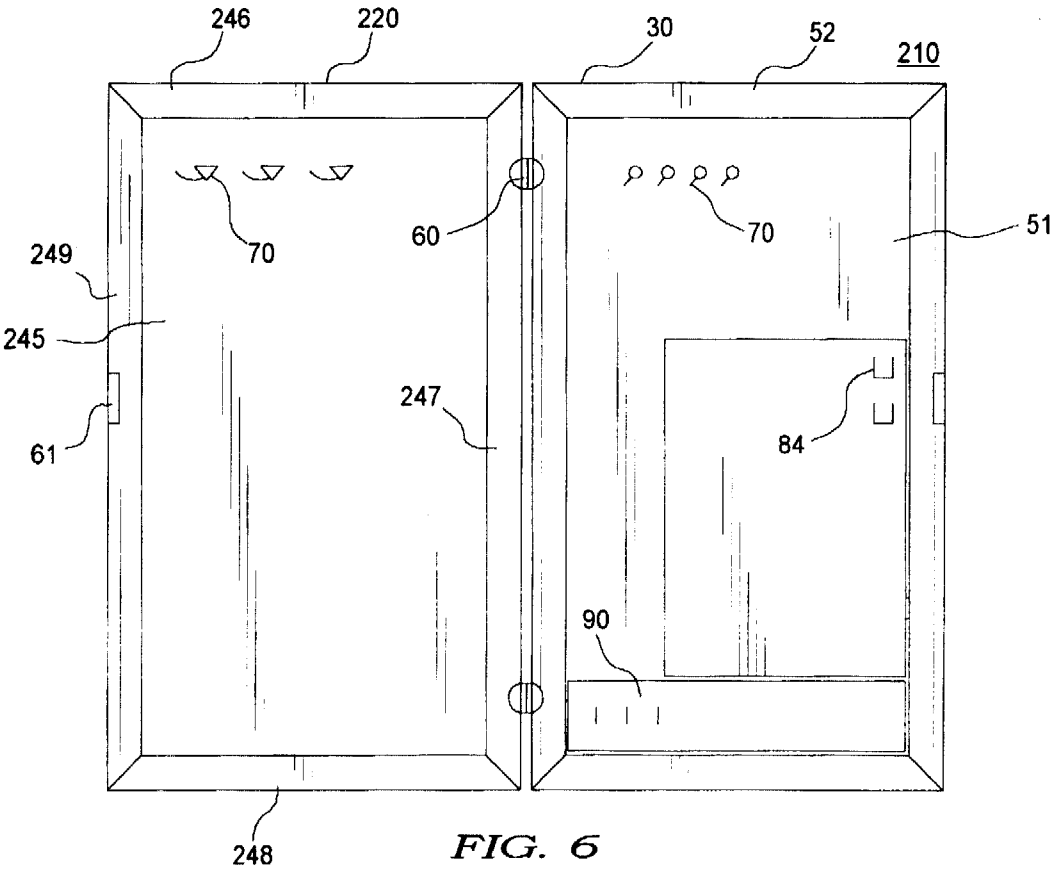
FIG. 6 shows an embodiment of the present invention with an enlarged cover.
Figure 7:
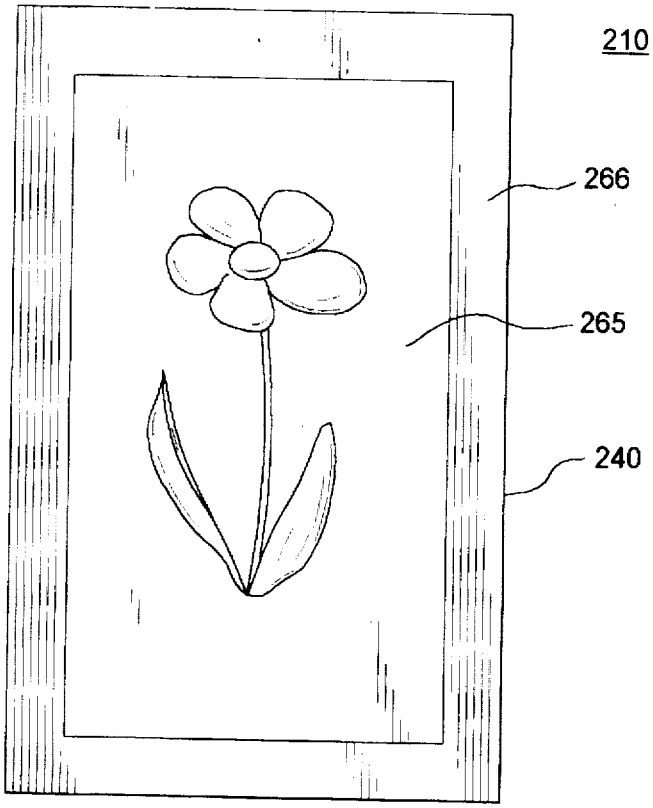
FIG. 7 shows the front cover of the embodiment shown in FIG. 6.

Referring now to FIG. 6, another embodiment of the present invention is shown and is depicted generally as 210. Items having same function and design shall be referenced by the numbers used above for FIGS. 1–3. In this configuration, front cover structure 220 is greater in size than rear box-type structure 30. This enhances the ability to conceal the true nature of jewelry security cabinet 210. As stated before, an outside surface (not shown) can be an oversized mirror or picture. Inner surface 245 of front cover structure 220 has a frame constructed around it with frame sides 246, 247, 248 and 249, as shown, which may frame the aforesaid mirror or picture. Referring to FIG. 7, front box-type structure 220 has a cover 240 to provide concealment. Cover 240 can be any one of a number of nominal wall-type decorations, including mirrors and picture frames. In this embodiment, cover 240 depicts a picture 265 with a wood finish frame 266.

Obviously, numerous modifications and variations of the present invention are possible in light of the above teachings. It is therefore understood that within the scope of the appended claims, the invention may be practiced otherwise than as specifically described herein.

What is claimed is:

1. A cabinet for the storage and display of objects, comprising:

a) a front cover structure having an outside cover surface and an inside display cover surface;

b) a rear box-type structure having a set of four side walls and a mounting surface adapted for attachment to a wall;

c) means for hingedly connecting said front cover structure to said rear box-type structure such that in an open condition an internal surface of each of said inside display cover surface and said mounting surface is exposed;

d) means for maintaining closure of said cabinet in a closed condition;

e) said internal surface of each of said inside display cover surface and said mounting surface having means for displaying said objects;

f) first means for removably attaching a first display case to said rear box-type structure;

g) second means for removably attaching a second display case;

h) a first display case removably attached to said rear box-type structure;

i) a second display case removably attached to said rear box-type structure;

j) means for carrying said first display case and said second display case;

k) means for removably attaching said means for carrying said first display case and said second display case to said internal surface of said rear box-type structure; and said means for carrying said first display case and said second display case mounted behind one of said first display case and said second display case.

2. The cabinet as claimed in claim 1, wherein:

a) said first display case is constructed from a clear plastic material and is adapted for holding pierced and clip-on earrings; and b) said second display case is a slotted ring holder.

3. The cabinet as claimed in claim 2, wherein said first means for removably attaching are comprised of a first set of looped and hooked filament attachment mechanisms.

4. The cabinet as claimed in claim 2, wherein said second means for removably attaching are comprised of a second set of looped and hooked filament attachment mechanisms.

5. The cabinet as claimed in claim 2, wherein said means for displaying said objects includes means for hanging necklaces, means for holding pendants, pins and rings, and means for retaining pierced earrings and clip-on earrings.

6. The cabinet as claimed in claim 5, wherein said means for displaying said objects has a fabric-type material covering.

7. The cabinet as claimed in claim 1, wherein said means for maintaining closure is a magnetic closure mechanism.

8. The cabinet as claimed in claim 1, wherein said outside cover surface has an appearance of a mirror.

9. The cabinet as claimed in claim 1, wherein said outside cover surface has an appearance of a picture.

10. The cabinet as claimed in claim 1, wherein said mounting surface adapted for attachment to a wall includes a means for hanging said cabinet on said wall.

11. The cabinet as claimed in claim 1, wherein said front cover structure has a predetermined width and a predetermined length which are greater than the width and length of said rear box-type structure.

* * * * *